United States Patent [19]

Peyton et al.

[11] Patent Number: 4,632,392

[45] Date of Patent: Dec. 30, 1986

[54] EXERCISE APPARATUS INCLUDING TETHERED MASS CONFINES FOR MOVEMENT ON HORIZONTAL TRACK

[76] Inventors: Ronald G. Peyton, 2935 Sope Creek Dr., Marietta, Ga. 30067; William D. McLeod, 7102 Moon Rd., Columbus, Ga. 31904

[21] Appl. No.: 391,556

[22] Filed: Jun. 24, 1982

[51] Int. Cl.[4] ..... A63B 21/00

[52] U.S. Cl. ..... 272/128; 272/143

[58] Field of Search ..... 272/116, 117, 120, 124, 272/128, 131, 133, 134, 135, 136, 137, 142, 143, 144; 273/191 R, 191 A, 191 B

[56] References Cited

U.S. PATENT DOCUMENTS

| | | | |
|---|---|---|---|
| 2,396,106 | 3/1946 | Kuznir | 272/124 |
| 2,783,045 | 2/1957 | Bosch | 272/120 |
| 2,871,017 | 1/1959 | Cook | 272/128 |
| 3,010,720 | 11/1961 | Allard | 272/117 |
| 3,545,748 | 12/1970 | Delinger | 272/117 |
| 3,743,280 | 7/1973 | Martinez | 172/116 |
| 3,794,329 | 2/1974 | Wilson | 273/191 A |
| 3,851,874 | 12/1974 | Wilkin | 272/136 |
| 3,858,873 | 1/1975 | Jones | 272/117 |
| 3,917,281 | 11/1975 | Oppenheimer | 273/191 B |
| 3,966,203 | 6/1976 | Bickford | 273/191 B X |
| 4,034,991 | 7/1977 | Oppenheimer | 273/186 A |
| 4,098,502 | 7/1978 | Faust | 272/144 |
| 4,226,414 | 10/1980 | Coffaro | 272/117 |

FOREIGN PATENT DOCUMENTS

| | | | |
|---|---|---|---|
| 463045 | 7/1928 | Fed. Rep. of Germany | 272/142 |
| 457018 | 7/1914 | France | 272/134 |
| 82/01471 | 5/1982 | PCT Int'l Appl. | 273/191 A |

*Primary Examiner*—Richard T. Stouffer

*Attorney, Agent, or Firm*—Jones & Askew

[57] ABSTRACT

An inertial exercise apparatus and method for exercising body muscles using acceleration and deceleration forces. A mass slidably mounted along a track is connected to a body part by a tether in such a way that the body part accelerates the mass along the track, and thereafter the motion of the mass is converted without substantially decreasing the speed of the mass to a motion which can be decelerated by the body part. In a preferred embodiment, the mass is accelerated toward a curved central portion of the track which then reverses the motion of the mass, after which the mass is decelerated. A rotating mass can also be utilized.

2 Claims, 7 Drawing Figures

35

EXERCISE APPARATUS INCLUDING TETHERED MASS CONFINES FOR MOVEMENT ON HORIZONTAL TRACK

TECHNICAL FIELD

The present invention relates to apparatus for exercising muscles of the human body, and more particularly relates to an inertial exerciser for using acceleration and deceleration forces to exercise muscles of body parts.

BACKGROUND ART

In most activities, muscles of the body are required to provide forces for two functions. One primary function is to overcome resistive loads which in general include friction and gravity forces. The second primary function is to provide a force to accelerate and decelerate the body part itself plus any extra mass imposed on the body part. The proportion of these two functions varies depending upon the activity and the specific limb and joint engaged in the activity. In medical terminology, an acceleration force is produced by a concentric contraction while a deceleration force is produced by an eccentric contraction.

In throwing and racket sports, the importance of the acceleration and deceleration function of the muscles cannot be overestimated. A major league pitcher who throws a fast ball at 95 miles per hour must accelerate his arm to that speed and more before releasing the ball, and the arm must then be decelerated to avoid injury. Thus, the deceleration forces generated within a muscle can be very high.

In most known devices for exercising body muscles, the body part involved moves in one direction against a resistance, and then comes to a stop, followed by return motion to the starting point. Such exercises involve both resistive loads and acceleration and deceleration forces. In weight lifting, the resistive loads are very high. The acceleration and deceleration forces can also be high because the forces are proportional to the amount of mass being accelerated as well as to the rate of acceleration. During a bench press it has been shown that the acceleration forces can be as high as 35–40 percent of the weight being pressed. U.S. Pat. No. 3,851,874 discloses an exercise apparatus involving both resistive and acceleration/deceleration forces, wherein a cord passing through a pulley is pulled to lift a suspended weight at the other end of the cord or to stretch a spring. U.S. Pat. No. 2,396,106 discloses an exerising device including a handle joined to a weight by means of an elongate spring steel blade, so that the weight oscillates and causes vibratory stimulation of the body parts.

U.S. Pat. Nos. 3,917,281; 4,034,991 and 3,794,329, each disclose swing training apparatus in which a golf club or the like is guided by being slidably attached to a track in order to teach an accurate swing trajectory.

SUMMARY OF THE INVENTION

The present invention provides a novel exercise apparatus capable of exercising body muscles using acceleration and deceleration forces. The apparatus allows momentum, generated during concentric contraction of the muscles in order to produce an acceleration force, to be converted to place the muscles into eccentric contraction to produce a deceleration force. The apparatus can be used to provide a repetitive acceleration/deceleration muscle loading cycle.

Generally described, an exercise apparatus embodying the present invention for exercising the muscles of a body part comprises a mass, means for connecting the body part to the mass such that force applied to a first direction by the body part accelerates the mass, and, after a predetermined amount of movement of the mass, decelerates the mass, the change from acceleration to deceleration of the mass occurring without significant decrease in the speed of the mass.

An exercise apparatus embodying the present invention for exercising the muscles of a body part can comprise a mass confined for movement along a path, means for changing the direction of movement of the mass along the path without significantly decreasing the speed of the mass, and interconnecting means for connecting the mass to the body part, the interconnecting means being operable by the muscles of the body part to accelerate the mass along the path to the location at which the mass changes direction, and to decelerate the mass after the mass changes direction. The path preferably comprises a guide track with the mass being slidably mounted for movement along the guide track, and the means for changing the direction of the mass preferably comprises a curve in an intermediate portion of the guide track. In the preferred embodiment, the curve in the guide track turns 180°. The interconnecting means preferably comprises a tether attached to the mass and passing through a tether guide ring adjacent to the curve in the guide track, so that when the tether is pulled the mass is accelerated toward the tether guide ring, is changed in its direction of travel by the curve in the guide track, and changes direction without any substantial decrease in speed so that the tether is pulled through the tether guide ring in the opposite direction as the body part exerts a force thereon to decelerate the mass.

The apparatus can also comprise a linear track, a mass slidably mounted for movement along the linear track, a tether attached at one end thereof to the mass, and at the other end thereof to handle means for engaging a body part so as to permit the tether to be pulled by the body part, and tether guide means adjacent to a central location along the linear track for confining the tether to a given area, whereby the tether is pulled to accelerate the mass from one end of the track until the mass passes the tether guide means, and thereafter the mass pulls against the tether.

A method of exercising muscles of a body part embodying the invention comprises the steps of accelerating a mass with the muscles of the body part by moving the body part in a first direction, changing the direction of movement of the mass independently of the muscles of the body part without significantly decreasing the speed of the mass, and decelerating the mass with the muscles of the body part while moving the body part in a second direction opposite to the first direction. In one mode, the method can be carried out by accelerating the mass by pulling the mass toward the body part and, subsequent to the change of direction of the mass, pulling against the movement of the mass to decelerate the mass. In another mode, the method can comprise pushing against the mass to accelerate the mass away from the body part and, subsequent to the change of direction of the mass, pushing against the mass to decelerate the mass.

In the method and apparatus of the present invention, it is preferable that the path of travel of the mass be in an approximately horizontal plane, in order to minimize the influence of gravity on the primarily acceleration and deceleration forces created during operation of the invention.

Thus, it is an object of the present invention to provide an inertial exercise apparatus for exercising body muscles using acceleration and deceleration forces.

Another object of the present invention is to provide an inertial exercise apparatus in which a body part is connected to a mass in order to move the mass in such a way as to create acceleration and deceleration forces in the muscles of the body part.

Other objects, features and advantages of the present invention will become apparent upon consideration of the following detailed description of embodiments of the invention, when taken in conjunction with the drawing and the appended claims.

DETAILED DESCRIPTION

Figure 1:
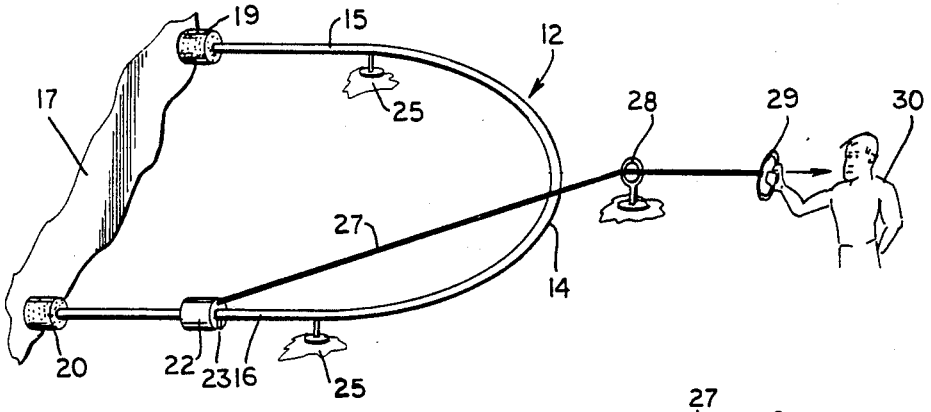
FIG. 1 is a schematic representation of a preferred embodiment of the present invention, illustrating one mode of operation of the apparatus.

Referring now in more detail to the drawing, FIG. 1 shows a schematic representation of an inertial exercise apparatus 10 embodying the present invention. The apparatus 10 includes a horizontal curved track 12. The track 12 includes a 180° bend, the center of which is designated as point 14. The point 14 is also the center of the track 12, which includes two straight legs 15 and 16 extending from the curve and being rigidly attached to a vertical support surface 17 at the opposite ends of the track 12. A pair of shock absorbers 19 and 20 are mounted adjacent or surrounding the track 12 where the opposite ends of the track 12 meet the support surface 17. It will be understood that the shock absorbers 19 can be provided with an adjustable mounting to permit them to be positioned closer to the midpoint 14 of the track 12 so as to vary the effective length of the track 12.

Slidably mounted for travel along the track 12 is a mass 22 which includes a sleeve-type bearing 23 to reduce the friction between the mass 22 and the track 12 as much as possible. The mass is preferably thin in profile, and is sufficiently short in its dimension along the track 12 to be able to freely negotiate the radius of curvature of the track 12. The radius of curvature of the track 12 can be selected in order to vary the quickness with which the direction of movement of the mass 22 is changed as the mass 22 travels along the track 12. A plurality of track supports 25 are provided to either support the track 12 from beneath as shown, or suspend it from above. The mass 22 and bearing 23 are constructed in a well known manner to that the track supports 25 do not interfere with the movement of the mass 22 along the track 12. The mass can be removed from the track 12, so that a mass of a desired weight can be selected to fit the needs of a particular user.

A tether 27, such as a flexible cord or cable, is detachably fixed at one end thereof to the mass 22. Intermediate the length of the tether 27, the tether 27 passes through a tether guide ring 28, which is mounted adjacent to the track 12 near the center point 14, and confines the path of travel of the tether 27 to a given area between the track and the tether guide ring 28. Attached to the opposite end of the tether 27 is a handle or grip 29 adapted to be grasped or otherwise engaged by a person 30. As shown in FIG. 1, the person 30 is grasping the handle 29 with a hand. However, it should be understood that the grip can be constructed to be temporarily engaged with any portion of the body that can be moved about a joint.

In operation of the inertial exercise apparatus 10, a body part is engaged with the handle 29. In FIG. 1, a person 30 is shown grasping the handle 29 with a hand, ready to pull the handle 29 away from the tether guide ring 28. The starting position of the mass 22 is adjacent to one of the shock absorbers 19 or 20. Exertion of force by the person 30 accelerates the mass 22 along the track 12, and this involves a concentric contraction of the arm and shoulder muscles producing an acceleration force in the muscles. As the mass approaches the center point 14 of the track 12, the track 12 curves and redirects the motion of the mass in the opposite direction without slowing the mass. Since the mass is now moving away from the person 30, the force of the mass attempts to pull the tether 27 back through the tether guide ring 28. Opposition of the person 30 to this force of the mass involves an eccentric contraction of the arm and shoulder muscles producing a deceleration force in the muscles. In this phase of the exercise, the body part is moving in a direction opposite to that required for accelerating the mass 22. The exercise is complete when the person 30 has stopped motion of the mass 22 at a point along the opposite leg of the track 12 from that along which movement of the mass 22 began. If the person 30 is not able to completely stop motion of the mass 22, deceleration is completed by the shock absorber 19 or 20. If desired, the person 30 may immediately begin to repeat the exercise by pulling on the tether 27 to begin to accelerate the mass 22 in the opposite direction along the track 12.

As will be seen from the foregoing discussion of operation of the apparatus 10, the track 12 is preferably disposed in a horizontal plane, since tilting of the track 12 out of the horizontal plane would introduce the effect of gravity into the exercise.

Figure 2:
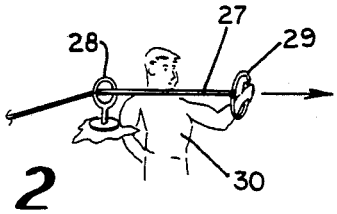
FIG. 2 is a schematic representation of a portion of the apparatus shown in FIG. 1, illustrating a second mode of operation thereof.

FIG. 2 shows a different mode of operation of the apparatus 10. In FIG. 2, the person 30 is shown ready to exert a force upon the tether 27 by pushing against the handle 29, instead of pulling against the handle 29 as was the case in FIG. 1. The movement of the mass 22 is exactly as described in connection with FIG. 1, the only difference being that the person supplies the acceleration and deceleration forces by a pushing motion instead of by a pulling motion.

Figure 3:
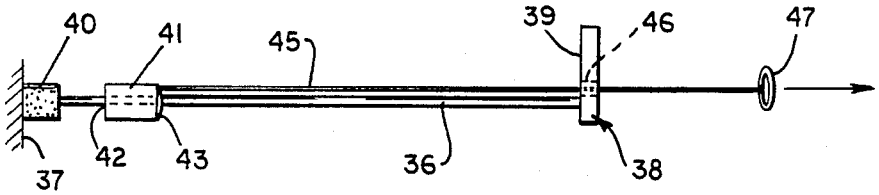
FIG. 3 is a schematic illustration of a second embodiment of the inertial exercise apparatus according to the invention.

FIG. 3 shows a second embodiment of an inertial exercise apparatus 35 embodying the present invention. In the embodiment shown in FIG. 3, the apparatus 35 includes a linear track 36 extending between a vertical support 37 and a rigid barrier 38. The barrier 38 is relatively massive and includes a resilient surface 39, such as stainless steel, facing the vertical support 37. A shock absorber 40 is provided on the track 36 adjacent to the vertical support 37.

A mass 41 including a bearing 42 is mounted for slidable movement along the track 36 in a manner similar to that described above in connection with the mass 22 of FIG. 1. The mass 41 further includes a rounded hardened contact surface 43 on the end of the mass facing the barrier 38. A tether 45 extends from the mass 41 through a small guide opening 46 in the barrier 38 to a handle or grip 47.

In operation of the embodiment shown in FIG. 3, the handle 47 is engaged with a body part and pushed or pulled to move the mass 41 from a position adjacent to the support 37 along the track 36 toward the barrier 38. When the mass 41 reaches the barrier 38, and the hardened contact surface 43 engages the resilient surface 39 of the barrier 38. a nearly elastic collision occurs, and the mass 41 returns toward the support 37 without any substantial reduction in speed of the mass 41. This results in the acceleration forces, created in the muscles of the body part during the pulling of the mass 41 toward the barrier 38, being immediately converted into deceleration forces as the muscles attempt to slow down the movement of the mass 41 away from the barrier 38. The shock absorber 40 completes deceleration of the mass 41 if the person using the apparatus 35 is unable to completely stop the mass 41. As in the embodiment shown in FIG. 1, the mass 41 of FIG. 3 can be accelerated and decelerated by either a pulling or a pushing action.

Figure 4:
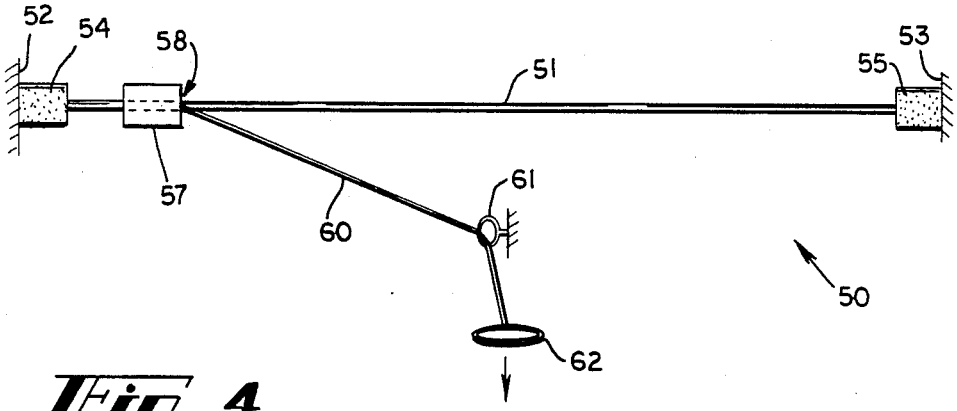
FIG. 4 is a schematic representation of a third embodiment of an exercise apparatus according to the invention.

FIG. 4 shows a third embodiment of an inertial exercise apparatus 50 according to the present invention. The apparatus 50 includes a linear track 51 which extends between two vertical supports 52 and 53. Shock absorbers 54 and 55 are provided adjacent to the supports 52 and 53. A mass 57 including a bearing 58 is slidably mounted for movement along the track 51. A tether 60 extends from the mass 57 through a tether guide ring 61 that is mounted adjacent to the track 51 midway along the length of the track 51. A handle 62 is attached to the end of the tether 60 opposite the end attached to the mass 57.

Operation of the embodiment shown in Fig. 4 is similar to that described above in connection with the other embodiments. The person utilizing the apparatus 50 exerts a force on the handle 62 in a direction away from the track 51. The force is exerted along the tether 60 to the mass 57, which begins to accelerate from a position adjacent to one of the vertical supports 52 or 53 toward the other vertical support. During the initial movement of the mass 57, acceleration forces are created in the muscles of the body part exerting a force on the handle 62. As the mass 57 passes the tether support ring 61, the mass 57 begins to pull the tether 60 back through the guide ring 61, and therefore pulls the body part toward the guide ring 61. The further motion of the mass 57 creates deceleration forces in the muscles of the body part as the muscles are used to decelerate the mass 57 to rest. It will thus be seen that although the mass 57 does not change its direction of travel, its motion converts acceleration forces in the muscles to deceleration forces very quickly and without any substantial decrease in the speed of the mass.

Figure 5:
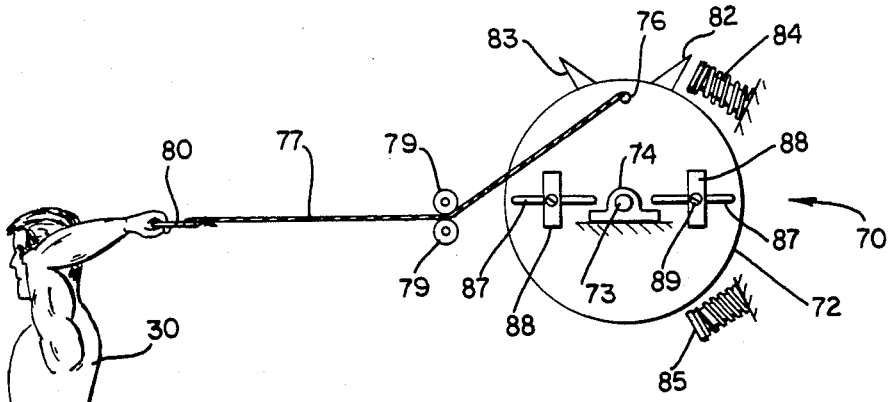
FIG. 5 is a schematic representation of a fourth embodiment of an exercise apparatus according to the invention.
Figure 6:
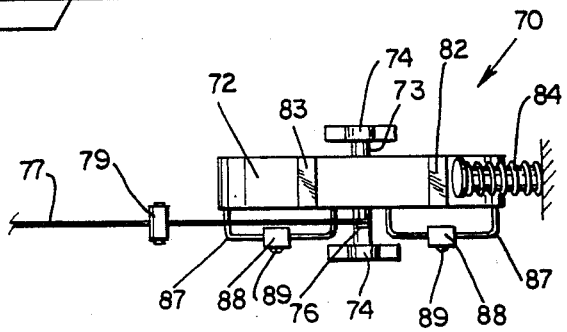
FIG. 6 is a top plan view of the exercise apparatus shown in FIG. 5.

FIGS. 5 and 6 show a fourth embodiment of an inertial exercise apparatus 70 according to the present invention. A mass in the form of a disc 72 is mounted for rotation about a horizontal axle 73 passing through the center of the disc 72 and fixed thereto. The axle 73 is journalled at its ends in a pair of bearings 74 that are appropriately supported on standards (not shown) or suspended from above. A tether 77 is attached at one of its ends to the side of the disc 72 at a point 76 located near the circumference of the disc 72. The tether 77 extends from the point 76 between a pair of guide rollers 79 located in the same horizontal plane as the axle 73. The tether then further extends to a handle 80 attached to its other end, such that a person 30 grasping the handle 80 can exert force away from the disc 72, and thereby cause rotation of the disc 72 about the axle 73. Although the person 30 is shown as grasping the handle 80 above and behind the person's head, it will be understood that the handle 80 can be adapted to receive other parts of the body, such as the feet, and can be pulled away from the disc 72 by any desired motion of a body part about a joint.

In the embodiment shown in FIG. 5, rotational movement of the disc 72 is limited by a pair of stops 82 and 83 extending from the circumferential surface of the disc 72. The stops 82 and 83 engage a pair of shock absorbers 84 and 85, respectively. The shock absorbers 84 and 85 are preferably moveable into varying positions around the disc 72, in order to change the amount of rotational motion of the disc 72 that is permitted. In FIG. 5, the stops 82, 83 and shock absorbers 84, 85 are positioned so that the point 76 at which the tether 77 is attached to the disc 72 is permitted to move from a position directly above the axle 73 to a position directly below the axle 73.

The mass of the disc 72 is balanced about any diameter thereof. The rotary inertia of the disc 72 can be varied by providing a pair of radial tracks 87 extending one on each side of the axle 73. Weights 88 are slidably mounted along the tracks 87, and can be fixed in desired postions along the tracks 87 by tightening set screws 89.

In operation of the embodiment of the invention shown in FIGS. 5 and 6, a body part is engaged with the handle 80, with the point 76 at which the tether is attached to the disc 72 located out of the horizontal plane of the axle 73. The force exerted on the handle causes rotational acceleration of the disc 72 until the point 76 passes through the plane of the axle 73, whereupon the force exerted on the handle is immediately converted to a force attempting to decelerate the mass 72. The acceleration of the disc 72 produces an acceleration force in the muscles of the body part. When the point 76 passes through the plane of the axle 73 and changes the direction of the tether 77, a deceleration force is produced in the muscles of the body part. The conversion from acceleration to deceleration occurs essentially instantaneously without slowing of the speed of rotation of the disc 72. If the person 30 is not able to completely stop motion of the disc 72, one of the stops 82, 83 will engage its respective shock absorber 84, 85. Then, the exercise can be repeated by accelerating the disc 72 in the opposite rotational direction.

Figure 7:
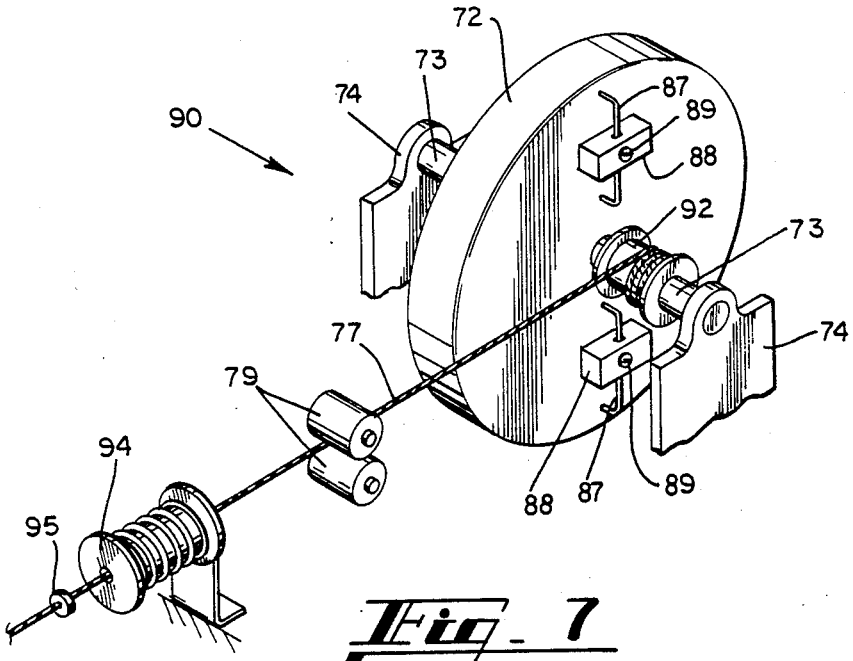
FIG. 7 is a partial perspective view of a fifth embodiment of an exercise apparatus according to the invention.

FIG. 7 shows a fifth embodiment of an inertial exercise apparatus 90 according to the present invention. The apparatus 90 is similar to the disc apparatus 70 shown in FIGS. 5 and 6. However, the tether 77 is attached at its end opposite the handle to a pulley 92 which rotates with the axle 73. This permits the tether 77 to wrap around the pulley 92 multiple times. Thus, in operation of the apparatus 90, beginning with the tether 77 wrapped around the pulley 92, exertion of the body part to pull the tether 77 away from the disc 72 causes rotational acceleration of the disc 72 by unwrapping the tether 77 from the pulley 92. The acceleration of the disc 72 may thus continue for several rotations of the disc, until the tether 77 is completely unwrapped from the pulley 92, at which time the rotation of the disc 72 will immediately begin to "reel in" the tether 77. Thus, continued exertion of the body part is immediately converted from a force tending to accelerate the disc 72, into a force tending to decelerate the disc 72. Because of the multiple rotations of the disc 72 in operation of the embodiment shown in FIG. 7, stops on the circumferential surface of the disc, such as stops 82 and 83 of the apparatus 70, are not suitable for stopping rotation of the disc 72 in the event that the person 30 is unable to do so. Therefore, a shock absorber 94 is fixedly mounted in the path of the tether 77. The shock absorber 94 includes a longitudinal opening through which the tether 77 freely passes. A stop 95 which will not pass through the opening in the shock absorber 94 is fixed to the tether 77 between the shock absorber 94 and the handle. Thus, the stop 95 limits the amount of the tether 77 that can be wound about the pulley 92, and stops rotation of the disc 72 upon engagement with the shock absorber 94.

Those skilled in the art will understand from the foregoing that the present invention provides a novel method and apparatus for exercising muscles of the body by creating primarily acceleration and deceleration forces in the muscles, rather than resistive forces. Thus, the present invention can be utilized to prepare persons for sports and other activities in which the acceleration and deceleration function of the muscles is important.

Although the present invention has been described in detail with particular reference to the preferred embodiments thereof, it should be understood that variations and modifications can be effected within the spirit and scope of the invention as described hereinbefore and in the appended claims.

We claim:

1. An inertial exercise apparatus comprising:

a horizontal track;

a mass slidably mounted for movement along said track;

a flexible tether attached at one end thereof to said mass and at the other end thereof to handle means for engaging a body part so as to permit said tether to be pulled by said body part; and tether guide means located at a fixed position relative to said track at an intermediate location between the ends of said track, said track defining a first portion one one side of said intermediate location and a second portion on the other side of said intermediate location;

said tether when operative extending slidably through said tether guide means and being pulled by said body part such that the net component of force exerted on said mass by said body part horizontally along said track is greater than the net component of said force in any plane perpendicular to said track, and said tether, when said mass is pulled on by said body part, being in a straight line in a first direction from said tether guide means to said one end when said mass is at one end of its path of motion in said first portion of said track and being in a straight line in a second direction from said tether guide means to said one end when said mass is at the other end of its path of motion in said second portion of said track.

2. An apparatus for exercising muscles of a body part, comprising:

a mass confined for movement along a horizontal track, said mass being movable along a horizontal path having first and second ends spaced apart along said track;

handle means for engaging said body part; and flexible interconnecting means, extending between said mass and said handle means, for loading muscles of said body part alternately and repeatedly with primarily acceleration and deceleration forces;

said connecting means when operative being pulled by said body part such that the net component of force exerted on said mass by said body part horizontally along said track is greater than the net component of said force in any plane perpendicular to said track;

said interconnecting means comprising a flexible tether passing through a tether guide positioned adjacent to and intermediate the ends of said horizontal path of said mass.

* * * * *